US005189892A

United States Patent [19]

Roberts

[11] Patent Number: 5,189,892

[45] Date of Patent: Mar. 2, 1993

[54] CONTAINER THAT COOLS LIQUIDS

[76] Inventor: Steven K. Roberts, 9311 Forrester Dr., Bradenton, Fla. 34202

[21] Appl. No.: 832,245

[22] Filed: Feb. 7, 1992

[51] Int. Cl.[5] ..... F25D 3/08

[52] U.S. Cl. ..... 62/372; 62/457.3; 62/457.4

[58] Field of Search ..... 62/457.1, 457.2, 457.3, 62/457.4, 457.6, 457.8, 529, 530, 371, 372; 220/605, 606, 630, 638

[56] References Cited

U.S. PATENT DOCUMENTS 2,075,137 3/1937 Rosen ..... 62/457.3

FOREIGN PATENT DOCUMENTS 0349895 6/1937 Italy ..... 62/457.1

0011178 of 1891 United Kingdom ..... 62/457.1

*Primary Examiner*—John Sollecito

*Attorney, Agent, or Firm*—Joseph C. Mason, Jr.; Ronald E. Smith

[57] ABSTRACT

A container that keeps liquids cold includes an upstanding hollow post that defines an upstanding cavity having an open end at the lowermost end of the container. A frozen plug is inserted into the cavity from the lowermost end and locked into place. The hollow post is made of a noninsulating material so that the cold plug lowers the temperature of the liquid in the container or reduces the rate of temperature increase of the liquid. The plug need not be maintained in a clean condition because it never comes into contact with the liquid in the container.

14 Claims, 1 Drawing Sheet

CONTAINER THAT COOLS LIQUIDS

TECHNICAL FIELD

This invention relates, generally, to containers for liquids. More particularly, it relates to a potable container having means for maintaining the potable in a chilled condition.

BACKGROUND ART

Beer and other beverages are commonly served in restaurants in large pitchers. Although breweries recommend that their product be served at thirty eight degrees Fahrenheit, the product heats up quite rapidly once served. The liquid in the bottom of a large pitcher will warm up to a temperature quite in excess of the ideal serving temperature by the time it is consumed. Thus, the customer's memory of the product is that it was quite tasty at first but somewhat disappointing later.

Several inventors have developed containers for keeping liquids cold, although not all of them have addressed the problem of cooling potables in large containers such as pitchers. For example, U.S. Pat. No. 5,044,173 to Cheng discloses a small cup having a hollow stick that screws into the cup from its bottom. A freezable liquid fills the hollow stick and keeps cold the liquids poured thereabout. The problem with this particular arrangement of parts is that the hollow stick must be kept meticulously clean because the liquid comes into direct contact with it. Thus, if the hollow stick and the liquid contained therein are placed in a freezer, the inside of the freezer must be clean so as to avoid contamination of the hollow stick and consequently of the liquid within which it will be immersed. Even if the inside of the freezer is kept clean, the hands of the individual inserting the hollow stick into the cup may not be.

An approach that avoids use of an insertable hollow stick is shown in U.S. Pat. No. 5,001,907 to LaCroix et. al. A cup is formed to have an annular chamber about the liquid-containing central cavity, and a freezable material is placed in the annular chamber. The problem with this combination of elements is that the entire cup must be placed in the freezer in order to freeze the freezable material. This is an impractical solution to the problem if applied to large pitchers.

All of the known containers for cooling liquids fall into the categories defined by Cheng and LaCroix et. al., i.e., all of the cooling inserts come into direct contact with the liquid being cooled, or the entire container must be frozen or cooled. See U.S. Pat. No. 4,531,383 to Zimmermann, U.S. Pat. No. 2,734,358 to Himmelfarb, U.S. Pat. No. 5,009,083 to Spinos et. al., U.S. Pat. No. 4,981,022 to Snyder, U.S. Pat. No. 3,840,153 to Devlin, and U.S. Pat. No. 5,067,328 to Medina et al.

Clearly, at the time the present invention was made, the prior art, when considered as a whole in accordance with the requirements of law, neither taught nor suggested to those of ordinary skill in the art how a breakthrough in such art could be achieved.

DISCLOSURE OF INVENTION

The present invention includes a hollow plug member that is filled with a suitable freezable material such as blue ice; the plug member alone is frozen prior to use. However, no care need be taken to keep said plug member olean because it never comes into contact with the liquid charged into the container. A hollow, upstanding post is formed in the container, and the cavity defined by the post is open at its lowermost end so that the frozen plug is slidably insertable therein. A suitable engagement means is provided to look the plug into the cavity. The walls of the post are formed of a noninsulating material so that the low temperature of the blue ice is easily communicated to the liquid within which the post is immersed. In this manner, the container is washed in the usual way, and the central post is thereby made as clean as the inner sidewalls and bottom wall of the container. The inserted plug need not be cleaned at all.

Thus it is seen that the primary object of this invention is to revolutionize the art of beverage-cooling containers by obviating cooling sticks that come into contact with the beverage being cooled and by eliminating the need to freeze an entire container.

Other objects, features and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

BEST MODE FOR CARRYING OUT THE INVENTION

Figure 1:
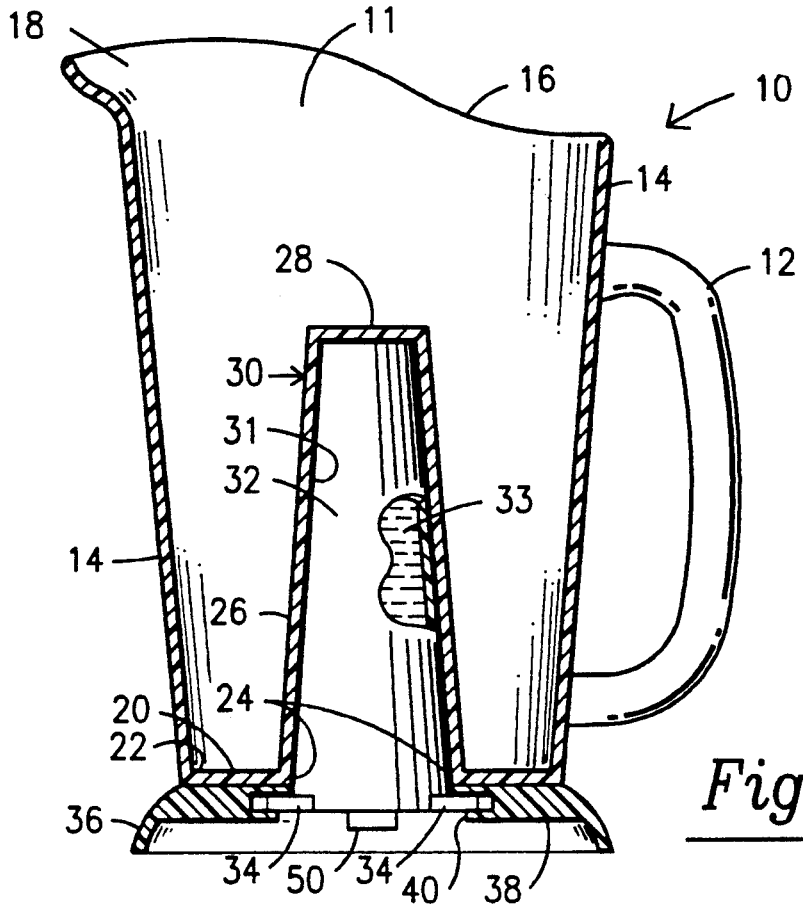
FIG. 1 is a sectional view of the novel container taken along line 1—1 in FIG. 2.

Referring now to FIG. 1, it will there be seen that an exemplary embodiment of the invention is denoted as a whole by the reference numeral 10.

Container 10 includes a conventional handle 12 that is integrally formed with and which extends radially outwardly from generally cylindrical, imperforate outer sidewalls 14. The uppermost end of sidewalls 14 form rim 16 and a spout 18 is formed in said rim.

Imperforate bottom wall 20 has an outermost peripheral edge 22 about which sidewalls 14 are mounted and from which said sidewalls upwardly project to define the cavity 11 into which a potable beverage is charged when container 10 is in use. A central aperture 24 is formed in said bottom wall, and inner sidewalls 26 are mounted about the periphery of said central aperture and project upwardly therefrom to form the sidewalls of the hollow post that receives the frozen plug when the invention is in use. The uppermost end of inner sidewalls 26 is capped by an imperforate closure means in the form of closure wall 28 as shown. Thus, liquid charged into cavity 11 immerses the hollow post, collectively denoted 30.

Plug 32 is also hollow and retains therewithin blue ice 33 or other suitable freezable substance that remains at low temperatures for extended time periods when exposed to room temperatures. Note that the plug has the same contour as the hollow post 30 and that it is easily slidably received within the hollow cavity 31 defined by said post. Post 30 and plug 32 are depicted as having a frusto-conical configuration, but that particular shape is not critical to the invention. The sidewalls of the post and plug as depicted are generally cylindrical, but said parts could be provided in many other forms, all of which are within the scope of this invention. For example, the transverse section of the post and plug could be circular as shown, square, triangular, or any other regular or irregular polygonal shape.

Moreover, post 30 may be made of a transparent material so that plug 32 is visible; advertising material could then be advantageously applied to the plug. A brewer's logo, for example, would appear to be immersed in the beer, and as such would provide a captivating display.

Figure 2:
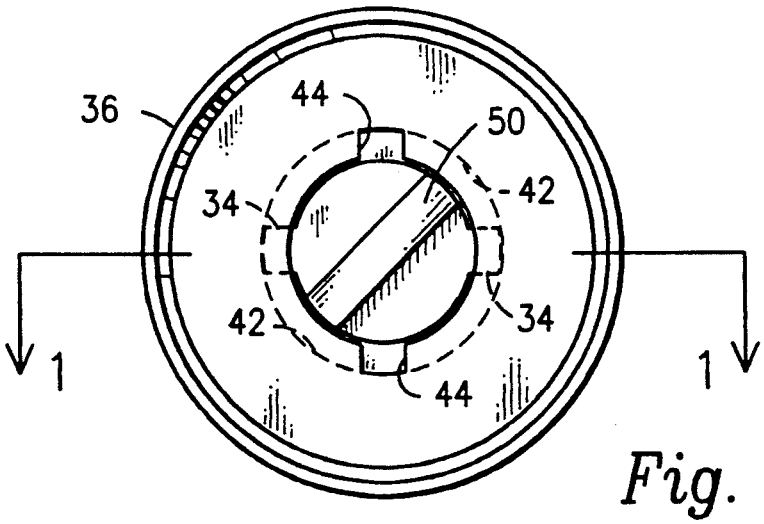
FIG. 2 is a bottom plan view.

As perhaps best shown in FIG. 2, a pair of diametrically opposed, radially outwardly extending tab members, collectively denoted 34, are integrally formed in plug 32 at the trailing end thereof. These tab members form a part of the engagement means that releasably secures the plug in its operable position as depicted in FIG. 1.

Bottom wall 20 of the container is supported about its outermost periphery by depending skirt 36; this skirt is provided in most pitchers in common use and performs the function of spacing the bottom wall of the pitcher from the table or other support surface upon which the pitcher is positioned.

A base wall 38 underlies and abuts container bottom wall 20; as depicted, said base wall is coextensive with said bottom wall, but such is not required. Like bottom wall 20, said base wall 38 is centrally apertured as at 40 so as not to block insertion of plug 32. An annular slot 42 is formed in base wall 38 in open communication with opening 40 and a pair of diametrically opposed, radially outwardly extending tab-receiving slots, collectively denoted 44, are formed in base wall 38 to admit tabs 34 into annular slot 42. Thus, a frozen plug 32 is removed from a freezer and its leading end is slidably inserted into hollow post 30 through opening 34 formed in base wall 38 and opening 24 formed in bottom wall 20. Tabs 34 at the trailing end of the plug 32 are aligned with tab-receiving slots 44 and inserted therethrough; the post 32 is then rotated in a clockwise or counterclockwise direction so that tabs 34 enter into annular slot 42 and thus out of alignment with tab-receiving slots 44, thereby locking the plug 32 into its FIG. 1 position. Reverse rotation of the plug accomplishes its removal. Handle 50 facilitates grasping of plug 32; it could be provided in many different forms, including finger-receiving recesses, for example.

Those skilled in the art of machine design will appreciate that other plug attachment means could be provided, now that the invention itself and a basic attachment means for the plug have been disclosed. For example, internal screw threads could be provided in opening 40 and external screw threads could be formed in the trailing end of plug 32 in lieu of tabs 34. Moreover, snap fitting means and numerous other releasable engagement means are within the scope of this invention.

This invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A container, comprising:

a bottom wall of predetermined geometrical configuration;

an opening of predetermined geometrical configuration being formed in said bottom wall;

said bottom wall having an outer peripheral edge and an inner peripheral edge that borders said opening;

imperforate outer sidewalls being mounted about the outer peripheral edge of said bottom wall and projecting upwardly therefrom;

imperforate inner sidewalls being mounted about the inner peripheral edge of said opening formed in said bottom wall and projecting upwardly therefrom;

an imperforate closure wall member for closing an uppermost end of said inner sidewalls;

said inner sidewalls and closure wall member collectively defining a post member, said post member being formed integrally with said bottom wall;

a cavity having an uppermost end defined by said closure wall member, a lowermost end defined by said opening formed in said bottom wall, and an outer periphery defined by said inner sidewalls;

a plug member having a main body part specifically configured and dimensioned, such that the outer surfaces of said main body part are in close conformity to and contact with said inner sidewalls and said closure wall member, to slideably fit within said cavity;

said plug member being hollow;

a freezable substance being permanently disposed within said hollow plug member, said freezable substance and said plug member being coolable prior to insertion of said plug member into said cavity;

said inner sidewalls and said closure wall member being formed of a substantially noninsulating material so that efficient heat transfer is obtained between said plug member and the liquid within said container; and engagement means formed integrally with said plug member for releasably positioning said plug member within said cavity;

said plug member and freezeable substance contained therein being frozen prior to insertion of said plug member into said post member;

whereby a potable is protected from contact with said plug member by said post member.

2. The container of claim 1, wherein said inner sidewalls are formed of a substantially noninsulating material so that efficient heat transfer is obtained between said plug member and the liquid within said container.

3. The container of claim 2, wherein said closure wall member is formed of a substantially noninsulating material so that efficient heat transfer is obtained between said plug member and the liquid within said container.

4. The container of claim 1, wherein the predetermined geometrical configuration of said bottom wall is circular, wherein the predetermined geometrical configuration of said opening is circular, wherein said outer sidewalls are generally cylindrical, and wherein said inner sidewalls are generally cylindrical.

5. The container of claim 1, further comprising a base means that supports said container and that spaces said bottom wall away from a support surface upon which said container may be positioned.

6. The container of claim 5, wherein said base means is provided in the form of an annular skirt that depends from the outer peripheral edge of said bottom wall.

7. The container of claim 6, further comprising a pair of diametrically opposed, radially outwardly extending tab members formed in a trailing end of said plug member, said tab members forming a part of said engagement means.

8. The container of claim 7, wherein said base means further includes a centrally apertured base wall having a predetermined thickness, said base wall disposed in underlying relation to said container bottom wall, said central aperture being in registration with a lowermost end of said cavity, an annular slot formed in said base wall that circumscribes said central aperture, and a pair of diametrically opposed, radially extending openings for admitting said tab members into said annular slot.

9. The container of claim 8, wherein said inner sidewalls are formed of a transparent material.

10. The container of claim 9, wherein said plug member includes a handle means for facilitating handling of said plug member.

11. A container, comprising:

a bottom wall of predetermined geometrical configuration;

an opening of predetermined geometrical configuration being formed in said bottom wall;

said bottom wall having an outer peripheral edge and an inner peripheral edge that borders said opening;

imperforate outer sidewalls being mounted about the outer peripheral edge of said bottom wall and projecting upwardly therefrom;

imperforate inner sidewalls being mounted about the inner peripheral edge of said opening formed in said bottom wall and projecting upwardly therefrom;

an imperforate closure wall member for closing an uppermost end of said inner sidewalls;

said inner sidewalls and closure wall member collectively defining a post member;

a cavity having an uppermost end defined by said closure wall member, a lowermost end defined by said opening formed in said bottom wall, and an outer periphery defined by said inner sidewalls;

a plug member having a main body part specifically configured and dimensioned to slideably fit within said cavity;

engagement means for releasably positioning said plug member within said cavity;

said inner sidewalls being formed of a substantially noninsulating material so that efficient heat transfer is obtained between said plug member and the liquid within said container;

said closure wall member being formed of a substantially noninsulating material so that efficient heat transfer is obtained between said plug member and the liquid within said container;

the predetermined geometrical configuration of said bottom wall being circular, the predetermined geometrical configuration of said opening being circular, said outer sidewalls being generally cylindrical, and said inner sidewalls being generally cylindrical;

a base means that supports said container and that spaces said bottom wall away from a support surface upon which said container may be positioned;

said base means being provided in the form of an annular skirt that depends from the outer peripheral edge of said bottom wall;

a pair of diametrically opposed, radially outwardly extending tab members formed in a trailing end of said plug member, said tab members forming a part of said engagement means; and said base means including a centrally apertured base wall having a predetermined thickness, said base wall disposed in underlying relation to said container bottom wall, said central aperture being in registration with a lowermost end of said cavity, an annular slot formed in said base wall that circumscribes said central aperture, and a pair of diametrically opposed, radially extending openings for admitting said tab members into said annular slot.

12. The container of claim 11, wherein said inner sidewalls are formed of a transparent material.

13. The container of claim 12, wherein said plug member includes a handle means for facilitating handling of said plug member.

14. The container of claim 13, wherein said post member has a frustoconical configuration.

* * * * *